US005772532A

United States Patent [19]

Stiefel et al.

[11] Patent Number: 5,772,532

[45] Date of Patent: Jun. 30, 1998

[54] GOLF BALL

[75] Inventors: Joseph F. Stiefel, Ludlow, Mass.; Donald J. Bunger, Waterbury, Conn.

[73] Assignee: Lisco, Inc., Tampa, Fla.

[21] Appl. No.: 891,810

[22] Filed: Jul. 14, 1997

Related U.S. Application Data

[62] Division of Ser. No. 527,392, Sep. 13, 1995, Pat. No. 5,688,194.

[51] Int. Cl.[6] ..... A63B 37/14

[52] U.S. Cl. ..... 473/384

[58] Field of Search ..... 473/383, 384

[56] References Cited

U.S. PATENT DOCUMENTS 5,441,276 8/1995 Lim ..... 473/378

*Primary Examiner*—George J. Marlo

*Attorney, Agent, or Firm*—Donald R. Bahr; Laubscher & Laubscher

[57] ABSTRACT

A golf ball having a dimple-free equatorial line dividing the golf ball into two hemispheres;

each of the hemispheres has an equal number of dimples;

each hemisphere has a plurality of dimples arranged in a configuration about the surface thereof so that there are no repeating patterns within the hemisphere.

3 Claims, 7 Drawing Sheets

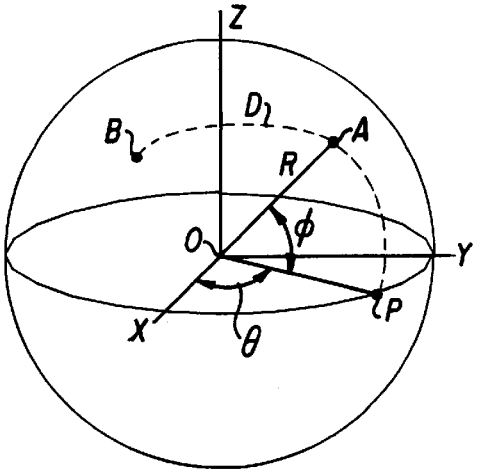
FIG. 1
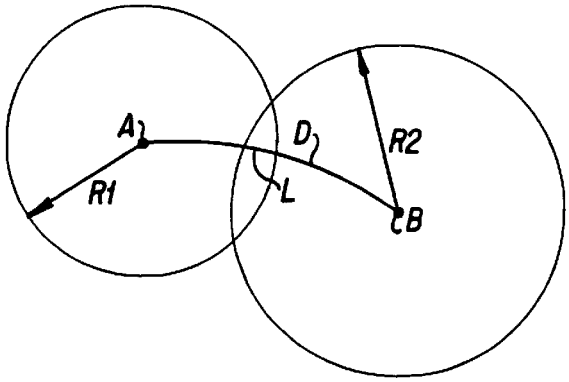
FIG. 2
FIG. 3
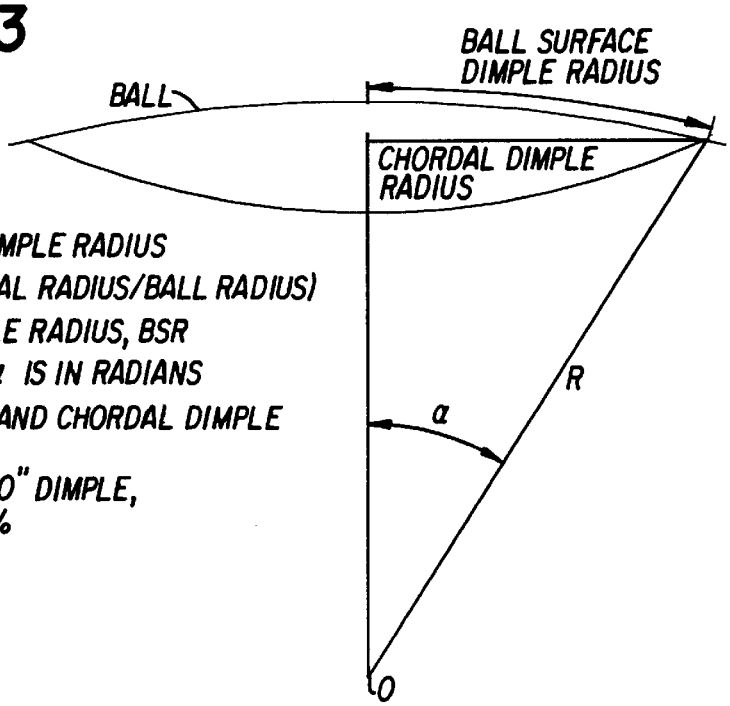
ANGLE α ACROSS DIMPLE RADIUS
α = ARCSINE (CHORDAL RADIUS/BALL RADIUS)
BALL SURFACE DIMPLE RADIUS, BSR
BSR = R * α, WHERE α IS IN RADIANS
DIFF. BETWEEN BSR AND CHORDAL DIMPLE RADIUS:
FOR 1.68 BALL, 0.100" DIMPLE,
DIFFERENCE = 0.06%
BSR = 0.05003"
CR = 0.05"

GOLF BALL

This application is a division of application Ser. No. 08/527,392, filed Sep. 13, 1995, now U.S. Pat. No. 5,688, 194.

This invention relates primarily to dimple configuration on the surface of a golf ball, and more particularly to a method of generating such dimple configuration and the resultant ball.

Modern day dimple configurations are generated on the basis of specific patterns which are repeated on the surface of a golf ball. These patterns are often variations on polyhedrons such as an icosahedron or the like with the dimples being adjusted to conform to the necessary requirements of molding a golf ball and maintaining a dimple-free equatorial line. The usual procedure for a spherical ball is to develop a pattern for one hemisphere of the ball which includes the repeated patterns within a section of the hemisphere. The final pattern is then repeated on the opposite hemisphere and arranged so that a dimple-free line exists equatorially between the two hemispheres.

The present invention departs from this basic concept in that it is not restricted to a derivation of the dimple configuration from a predetermined pattern. Rather, the number and sizes of the dimples are selected, randomly placed on the ball or a section thereof, and then moved in a plurality of steps until a configuration wherein dimple overlap is reduced to the desired minimum.

SUMMARY OF THE INVENTION

The dimple configuration for the surface of a golf ball is provided by selecting a fixed number of dimples and sizes of such dimples and placing the dimples on a computer model of one section of the ball in random locations without regard to other dimples present. Each dimple is identified, as are dimples which overlap it. For each dimple so identified, the aggregate component of overlap in the latitudinal and longitudinal directions is computed and the center of each dimple is then relocated so as to reduce the overlap. This step is repeated until the aggregate overlap is reduced to the desired minimum. The resultant ball has a dimple configuration such that there are no repeating patterns within the section. The ball is provided with suitable section multiples so as to cover the ball and optimally provide a dimple-free line on the ball.

BRIEF DESCRIPTION OF THE DRAWINGS

FIG. 1 is a schematic illustration of the location of related dimple centers;

FIGS. 2 and 3 are schematics illustrating the computation of dimple overlap;

DETAILED DESCRIPTION OF THE PREFERRED EMBODIMENT

Figure 4:
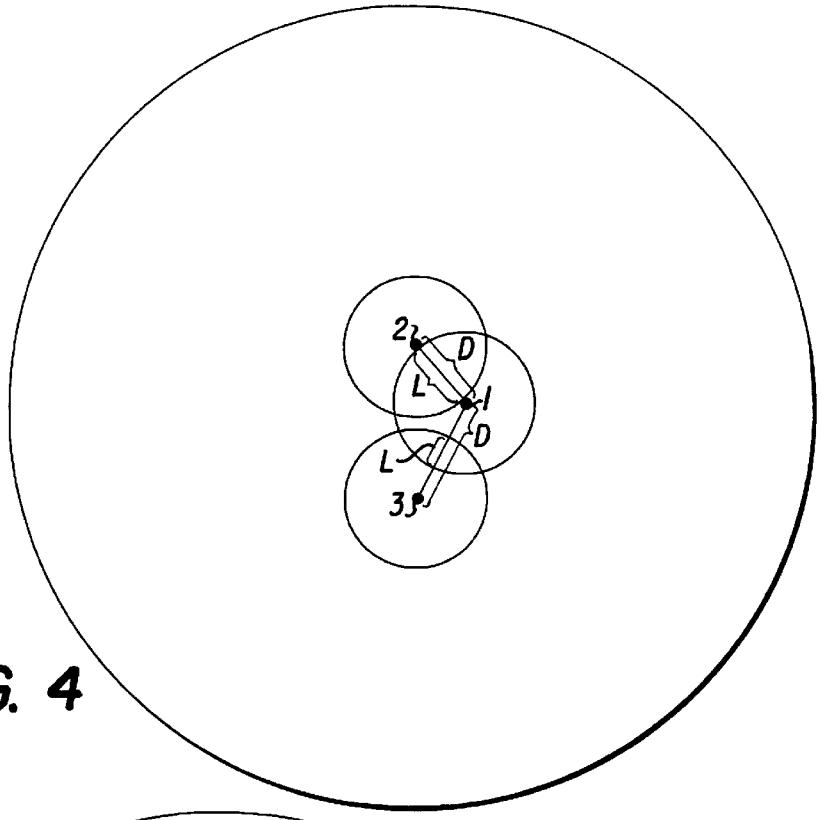
FIGS. 4–8 are schematics of the progressive steps illustrating the present invention relative to three dimples.

In practicing the present invention, certain preconditions must be determined before initiating development of a dimple configuration. First, one must choose whether to cover all of the ball, half the ball, or just a geometric section of the ball. Then, the number of the different dimple sizes, their diameters, and the allocated percentage of each size must be selected. The polar region may be precovered with a dimple "cap" to allow placement of vent and core pins in symmetric locations for ease in injection mold production. Boundary lines circumscribe the final area which the computer-generated dimples will cover, and can be lines on the sphere or immovable dimples on the sphere. This may include an equatorial band of dimples which are placed so that the bottom edges of the dimples coincide with the normal 0.007-inch flash line limit on the equator as well as the above-mentioned polar cap dimples. If it is desired to use just a section of the sphere, additional boundaries may be placed limiting the coverage to that particular section. For instance, when making 120° segments, boundaries would be placed in and along the longitudinal lines of 0° and 120° as well as the equatorial boundary.

When these preconditions have been completed, all required dimple sizes are placed on a model of a ball in computer-generated random or helter-skelter locations without regard to the other dimples present. This creates a heavily-overlapped confusion of dimples within the defined boundaries (see FIGS. 9 and 10).

Once the dimples have been placed on the ball as described above, the process of identifying and moving the dimples so as to provide the desirable minimal overlap begins. For those skilled in the art, there are many ways to approach the desired solution. There follows an example of one method of practicing the present invention.

In order to understand the principles of the present invention, reference is made to FIG. 1, which is a schematic illustration of a ball showing a three-dimensional placement of various points of interest. Referring to FIG. 1, the points as represented and associated principles are as follows:

| GEOMETRIC PRINCIPLES |
|---|
| A is Point on the Surface of a Ball Having Radius "R" |
| R = Line OA |
| A is located by the coordinates Phi and Theta, where |
| Phi = Angle AOP |
| and |
| Theta = Angle XOP |
| Note: Phi (latitude) = 0° with A at the equator and 90° with A at the pole. |
| Theta (longitude) = 0° with P at the x-axis and is |
| positive to the right, negative to the left through 180°. |
| The surface distance "D" from Point A to Point B along a great circle |
| whose center is 0 is given by simple spherical trigonometry as: |
| $D = R \times \text{ARCCOSINE}(F)$, where |
| $F = \text{SINE}(\text{Phi}_A) \times \text{SINE}(\text{Phi}_B) +$ |
| $\text{COSINE}(\text{Phi}_A) \times \text{COSINE}(\text{Phi}_B) \times \text{COSINE}(\text{Theta}_A - \text{Theta}_B)$ |

The method of determining the percent of linear overlap between any two dimples is illustrated in the schematic of FIG. 2. The reference points in FIG. 2 are as follows:

| PERCENT LINEAR OVERLAP BETWEEN TWO DIMPLES |
|---|
| A is the center of a dimple with a radius $R_1$ located at ($\text{Phi}_A$, $\text{Theta}_A$) |
| B is the center of a dimple with a radius $R_2$ located at ($\text{Phi}_B$, $\text{Theta}_B$) |
| D = Distance from A to B along a great circle path along the ball's surface. |
| Overlap $L = R_1 + R_2 - D$ |
| Percent Overlap $PCL = \frac{R_1 + R_2 - D}{R_1 + R_2} \times 100$ |

Note that the distances $R_1$ and $R_2$ used in FIG. 2 represent the chordal distances of the dimples' radii rather than the distance along the projected surface of the ball above the dimple (see FIG. 3). The difference in using the ball surface distance instead of the chordal distance is less than 1% and does not significantly impact the calculation of linear overlap. The ball surface distance could also be used.

The amount by which an individual dimple will be moved is determined by the following formulae:

| RELOCATION AMOUNT FOR A SINGLE DIMPLE (DUE TO LINEAR OVERLAP WITH ANOTHER DIMPLE) |
|---|
| For a dimple A, located at ($Phi_A$, $Theta_A$), and an overlapping dimple B, located at ($Phi_B$, $Theta_B$): Change $Phi_A$ by an amount PhiD, where PhiD = STP × [$Phi_A$ − $Phi_B$ (+/−) 0.1 × PCL], choosing sign (+/−) to match sign of ($Phi_A$ − $Phi_B$); and Change $Theta_B$ by an amount ThetaD, where ThetaD = STP × [$Theta_A$ − $Theta_B$ (+/−) 0.1 × PCL], choosing sign (+/−) to match sign of ($Theta_A$ − $Theta_B$). |

The step value, STP, governs the amount which an individual dimple will move during an iterative step. STP is generally some percentage of Total Overlap, TOVLP. TOVLP is the sum of all linear overlaps L for all of the dimples within the generated section. This allows large movement of dimples when TOVLP is large and the dimples are heavily overlapped, and small movement of dimples when the pattern nears solution and TOVLP is relatively small. It has been found practical to use the following discrete values of STP, although other values or a smoothly varying function of STP could be used:

| TOVLP | STP |
|---|---|
| >0.400 | 0.0500 |
| ≦0.400 | 0.0010 |
| <0.008 | 0.0005 |

Then for the entire section, the general relocation of all the dimples follows:

| GENERAL RELOCATION FORMULA (For Multiple Dimples on a Sphere) |
|---|
| FOR MULTIPLE DIMPLES 1–N RANDOMLY PLACED, SELECT EACH MOVABLE DIMPLE "A" IN SUCCESSION, AND: |
| 1) For every other dimple in the pattern, calculate the overlap, if any, onto dimple A. |
| 2) For every dimple B that does overlap dimple A, compute PhiD and ThetaD between dimples A and B. |
| 3) Accrue the values: PhiS = Sum of all PhiD<br>ThetaS = Sum of all ThetaD |
| 4) Relocate dimple A with<br>New $Phi_A$ = Old $Phi_A$ + PhiS<br>New $Theta_A$ = Old $Theta_A$ + ThetaS |
| 5) Repeat Steps 1–4 for each movable dimple A, from 1 to N. |

Steps 1, 2, 3, and 4 constitute one iteration.

Using the above principles, the computer program proceeds to mathematically slide the movable dimples around rapidly until they spread over the ball with desired minimal overlap.

While this program includes many other practical features, such as special sections for specifying and fixing equatorial and polar cap dimples, the crux of the algorithm is set forth in the general relocation formula set forth above.

The method will work for as many dimples as the ball will easily accommodate. The initial random placement assigns a number and radius to each dimple. The numbers are from 1 to n, and the radii are selected from any number of preselected values such that the desired percentage of each size is being used.

| GIVEN ELEMENTS | GIVEN ELEMENTS | EXAMPLE |
|---|---|---|
| Ball Radius | R | .841 Inch |
| Number of Dimples | N | 200 (Upper Hemisphere Only) |
| Number of Sizes | m | 5 |
| | | .060 Inch |
| | | .O65 Inch |
| | | .070 Inch |
| | | .075 Inch |
| Dimple Radii | R(A),A = 1,m | .080 Inch |
| | | 25% |
| | | 15% |
| | | 15% |
| | | 20% |
| Percent of Each Size | PC(A),A = 1,m | 25% |
| Location of Each | (Phi(A), Theta(A)) | A = 1,N |

A full example will be illustrated later. FIGS. 4–8 illustrate the process with a three-dimple example. Using the following legend:

| Dimple | Phi | Theta | R |
|---|---|---|---|
| 11 | 40.5° | 27° | .15 Inch |
| 12 | 48.0° | 16° | .15 Inch |
| 13 | 26.0° | 20° | .15 Inch |

three large overlapping dimples are taken:

| Dimple | Phi | Theta | R |
|---|---|---|---|
| 11 | 40.5° | 27° | .15 Inch |
| 12 | 48.0° | 16° | .15 Inch |
| 13 | 26.0° | 20° | .15 Inch |

It should be noted that the values Phi and Theta have been selected randomly for this example.

Refer to FIG. 1 for an explanation of the convention used in locating dimples using Phi, Theta values.

The initial positions are, thus:

| Dimple | Latitude | | | Longitude | | |
|---|---|---|---|---|---|---|
| Number | Degrees | Minutes | Seconds | Degrees | Minutes | Seconds |
| 11 | 40 | 30 | 0 | 27 | 0 | 0 |
| 12 | 48 | 0 | 0 | 16 | 0 | 0 |
| 13 | 26 | 0 | 0 | 20 | 0 | 0 |

Choose Dimple 11 first. Find the dimples which overlap dimple 11 by computing overlap L, as defined above, between dimple 11 and all other dimples, both movable and unmovable. In the present example it is found that dimples 12 and 13 overlap dimple 11. Using the above general relocation formula, it is found the new location of dimple 11 is as follows:

| | Latitude | | | Longitude | | |
|---|---|---|---|---|---|---|
| | Degrees | Minutes | Seconds | Degrees | Minutes | Seconds |
| Dimple 11 | 40 | 44 | 0 | 28 | 15 | 8 |

Repeat the above general relocation formula for dimple 12 and dimple 13. This is one iteration. The process continues until dimple overlap is reduced to the desired minimum. In the illustration, the final non-overlapping locations are as follows:

| Dimple | Latitude | | | Longitude | | |
|---|---|---|---|---|---|---|
| Number | Degrees | Minutes | Seconds | Degrees | Minutes | Seconds |
| 11 | 39 | 35 | 57 | 34 | 23 | 58 |
| 12 | 51 | 24 | 8 | 9 | 54 | 15 |
| 13 | 23 | 26 | 35 | 18 | 17 | 24 |

FIGS. 4–8 are illustrations of the above procedures using only three dimples in order to simplify the demonstration of the procedure.

FIG. 4 is the randomly-selected set of dimples. The relocation procedure is practiced in FIGS. 5–8. In each figure, the solid lines represent the new locations of the dimples and the dotted lines represent the locations of the dimple or dimples in the previous step.

Figure 5:
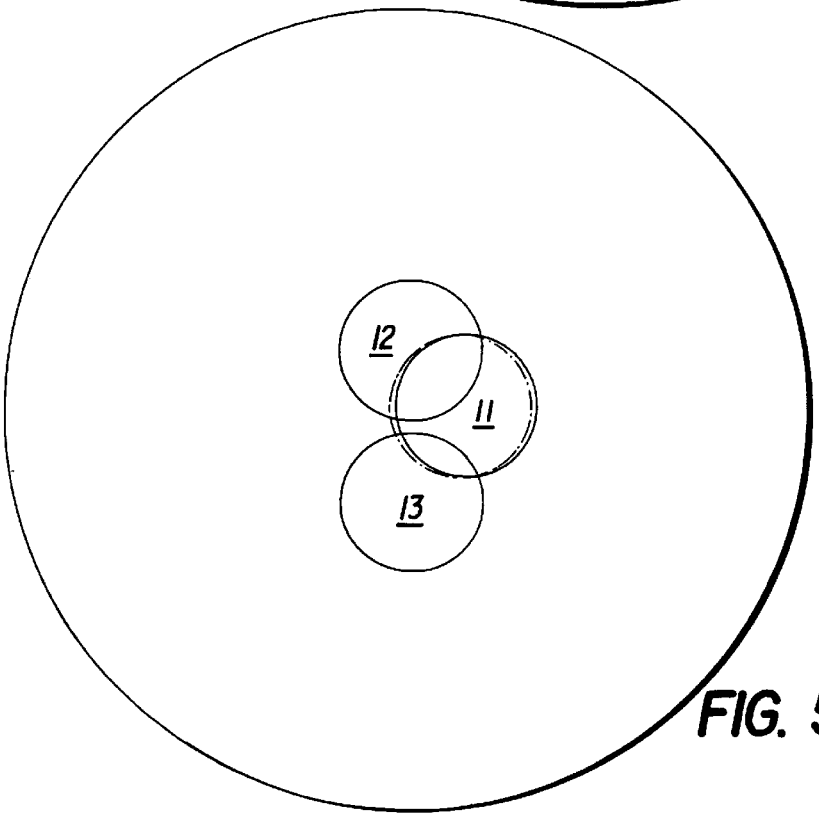
Figure 6:
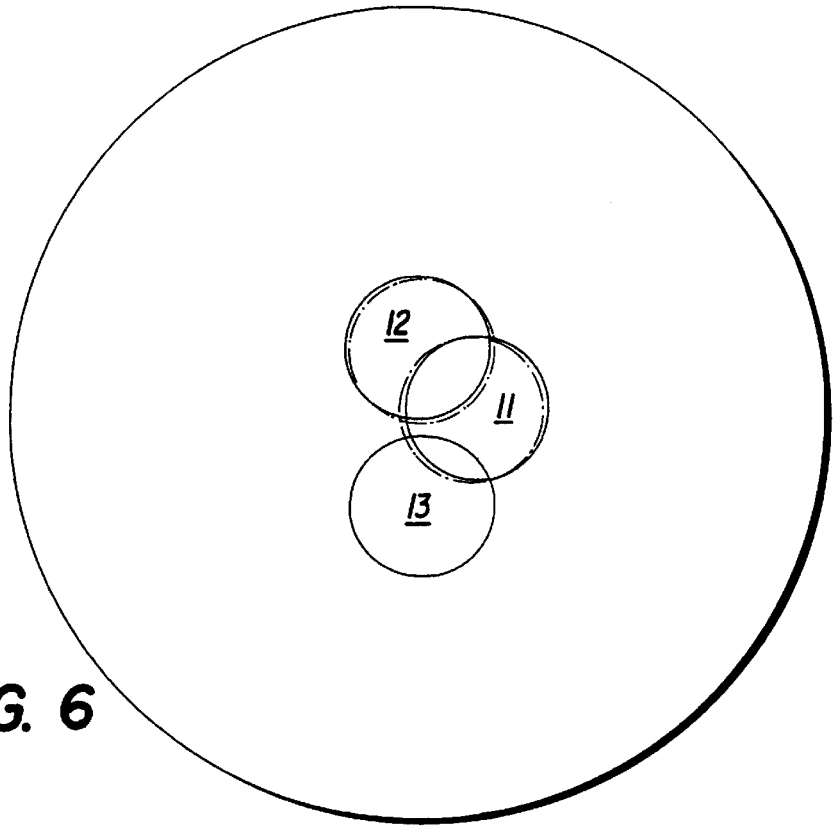
Figure 7:
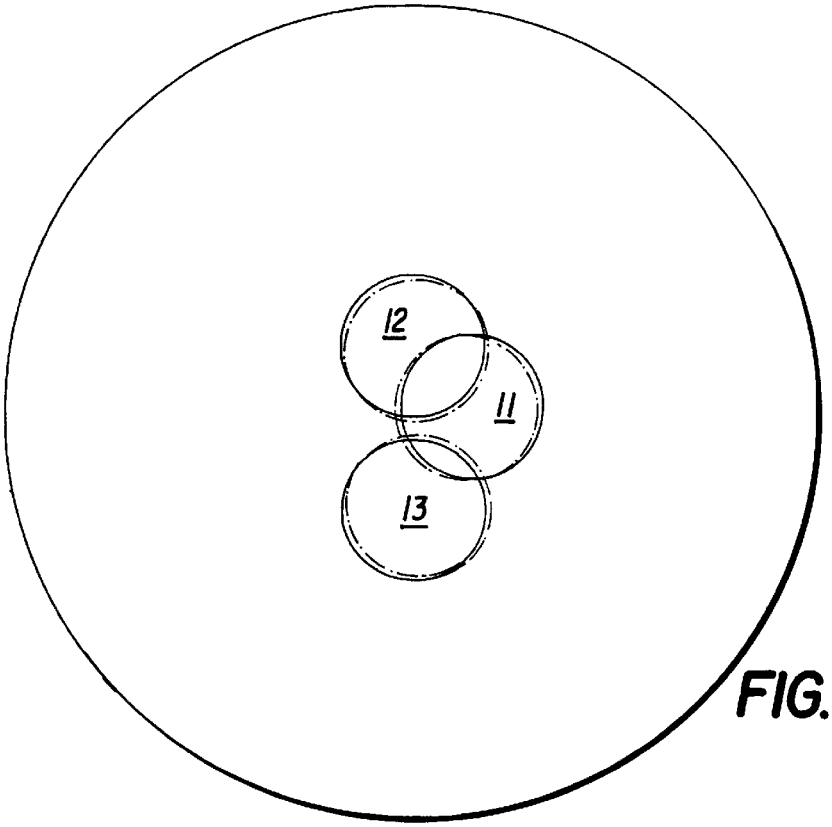
Figure 8:
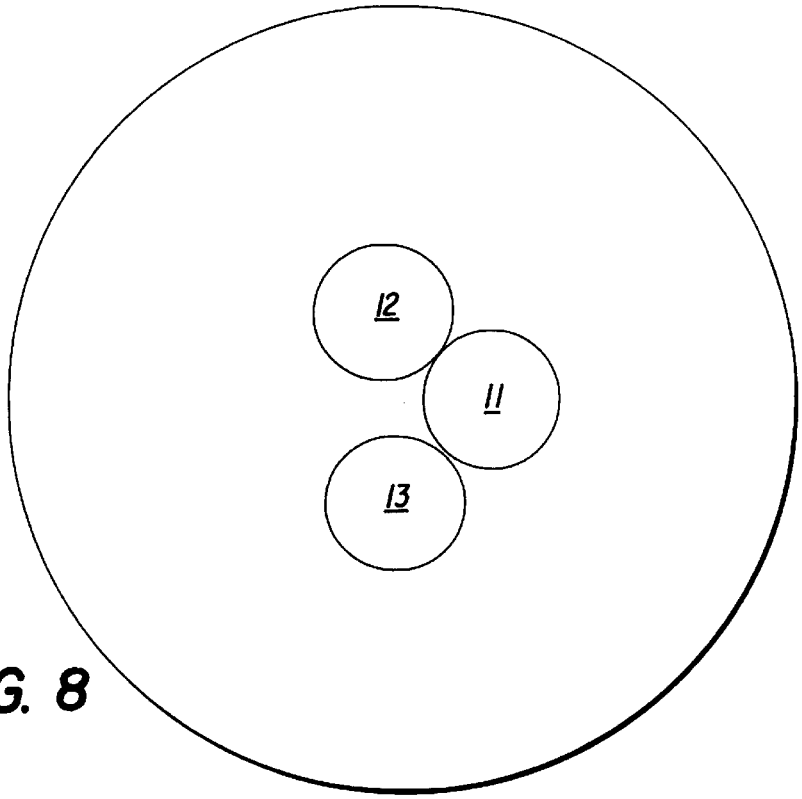

In FIG. 5, dimples 12 and 13 have not been moved. FIG. 6 shows dimple locations after moving dimples 11 and 12. FIG. 7 shows dimple locations after moving dimples 11, 12, and 13. This completes one iteration. These iterations continue until the dimple locations as shown in FIG. 8 are attained, at which time there is no dimple overlap.

Figure 9:
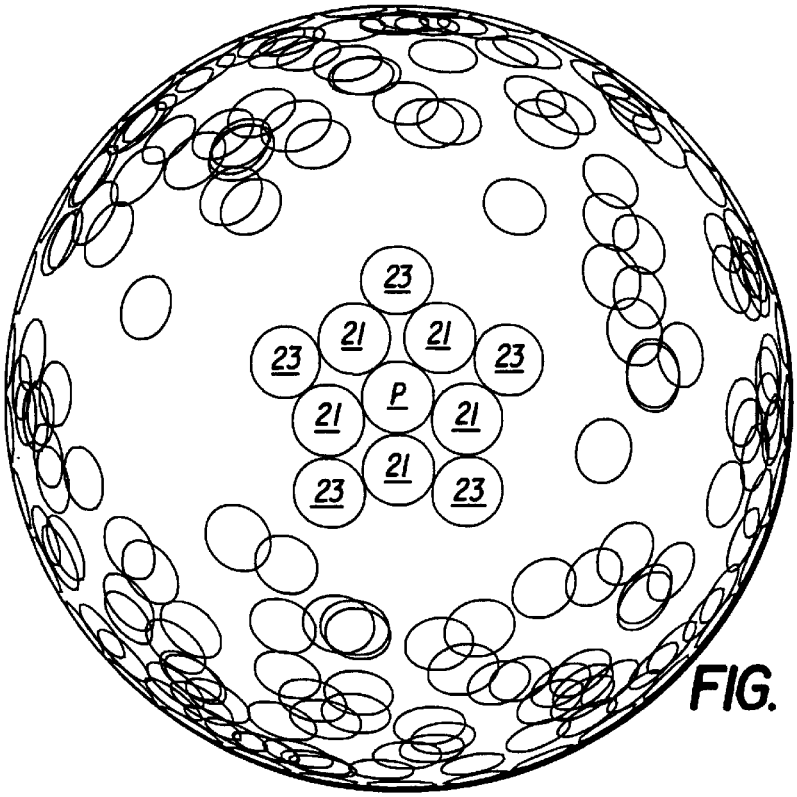
FIGS. 9–15 are schematic illustrations of the progressive steps of the present invention relative to location and movement of the dimples on a golf ball.
Figure 10:
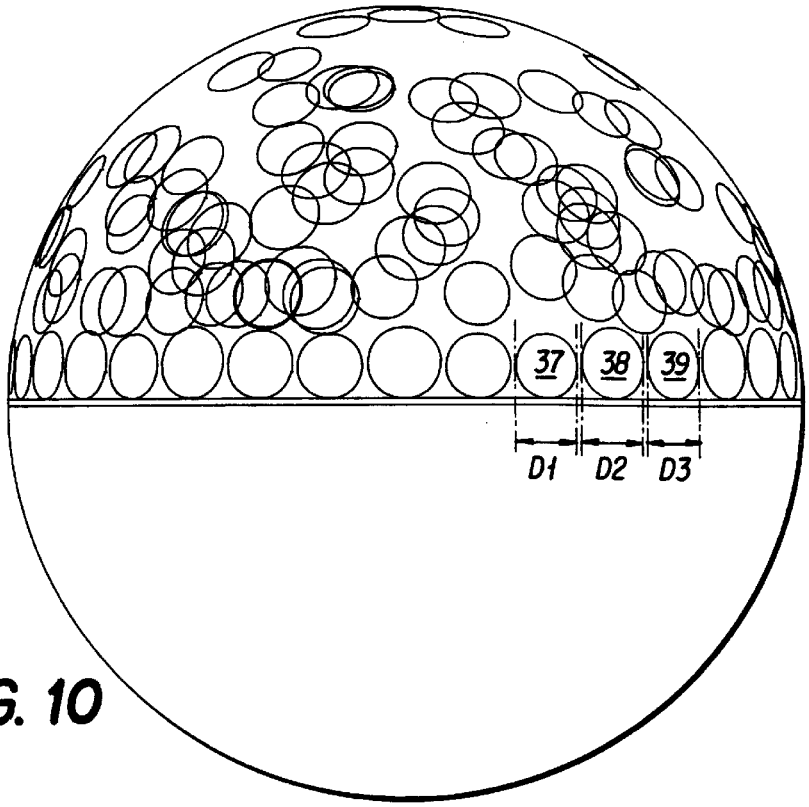

FIGS. 9 and 10 are illustrations of one particular starting procedure for developing the dimple pattern of the golf ball of the present invention.

FIG. 9 is a polar view of a golf ball. The pole dimple P is used as a vent dimple in a mold, and it is surrounded by five dimples 21. Dimples 23 are pin dimples used to support the core in the mold in a standard procedure. In order to space the pin dimples 23 properly from the pole so as to obtain a proper support with subsequent removal leaving circular dimples, spacing dimples 21 are used. The dimples comprising this cap do not move.

In like manner, FIG. 10 shows an equatorial view of the ball of FIG. 9. In this particular instance, a plurality of dimples 37, 38, and 39 having three different diameters, D1, D2 and D3, extend adjacent the equator with the 0.007 inch spacing required. These equatorial dimples are fixed and do not move during the iterative process.

Other than the polar cap dimples and the dimples adjacent the equator, the remaining dimples are placed on the hemisphere in a random or helter-skelter fashion, disregarding any possible dimple overlap. In the example shown, there are 202 dimples in one hemisphere of the ball; this number includes the polar cap and the equatorial dimples. There are 62 dimples having a 0.140 inch diameter, 77 dimples having a 0.148 inch diameter, and 63 dimples having a 0.155 inch diameter. This particular ball is designed to provide 78.2% dimple coverage on the surface of the ball.

Figure 13:
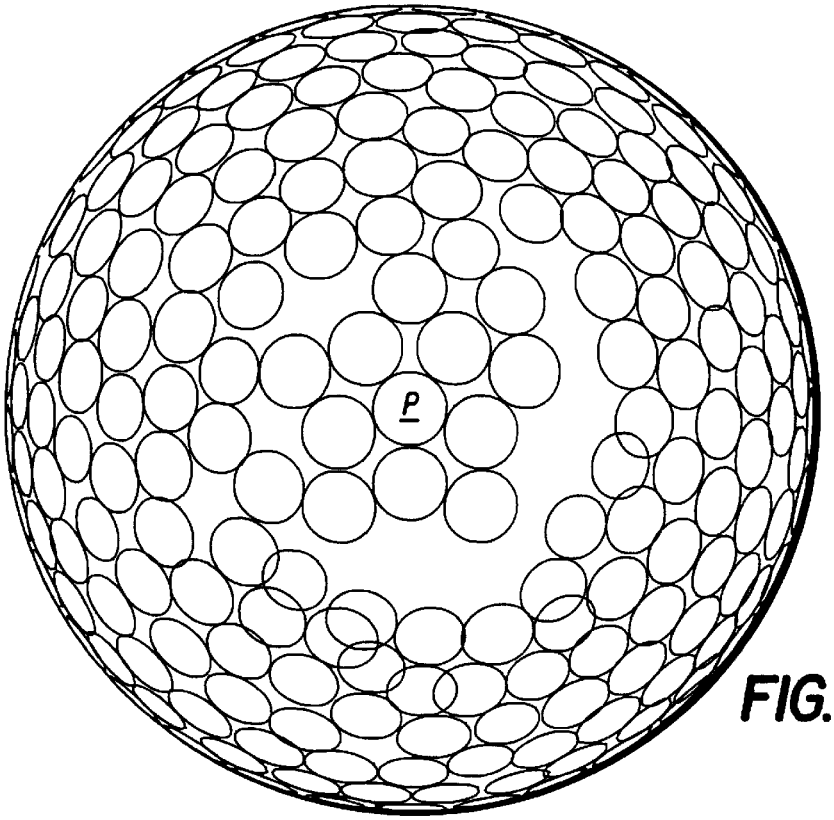
Figure 14:
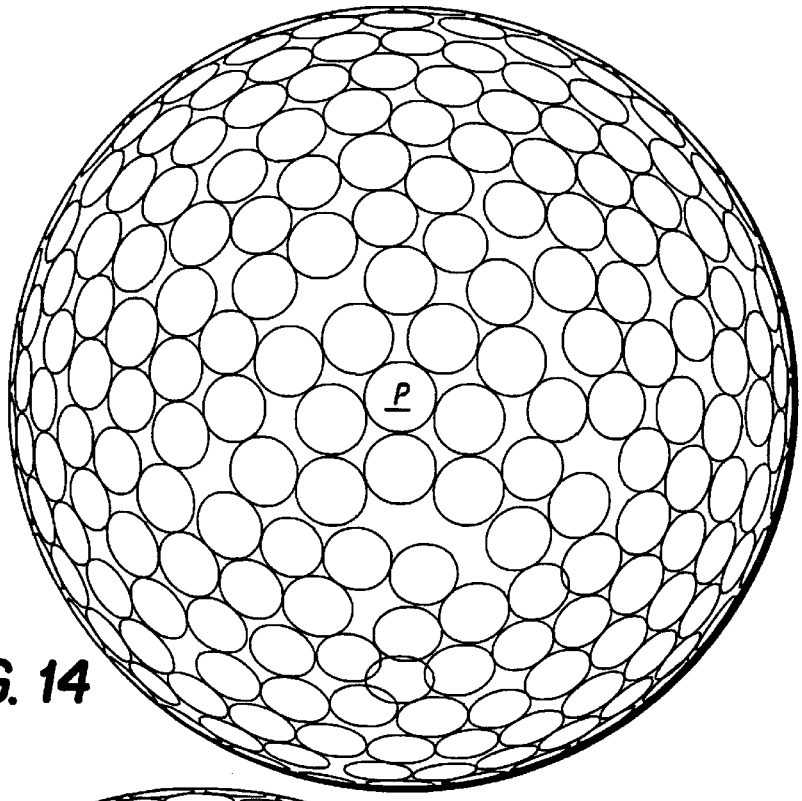
Figure 15:
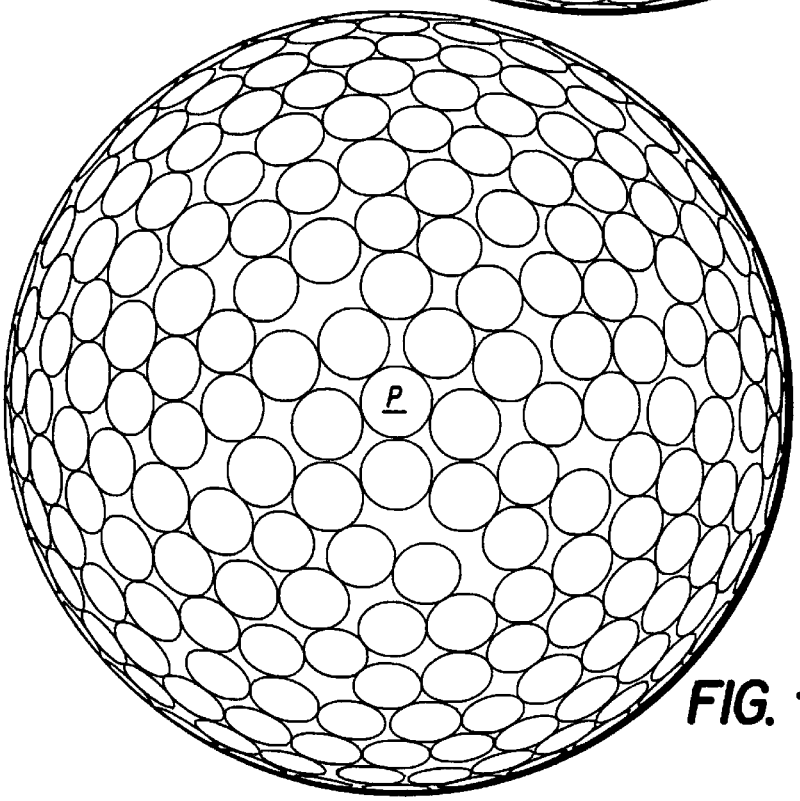

When the above process is followed, FIGS. 9 and 10–15 are polar views illustrating the position of the dimples during various steps of the procedure; FIG. 15 shows the completed configuration.

Figure 11:
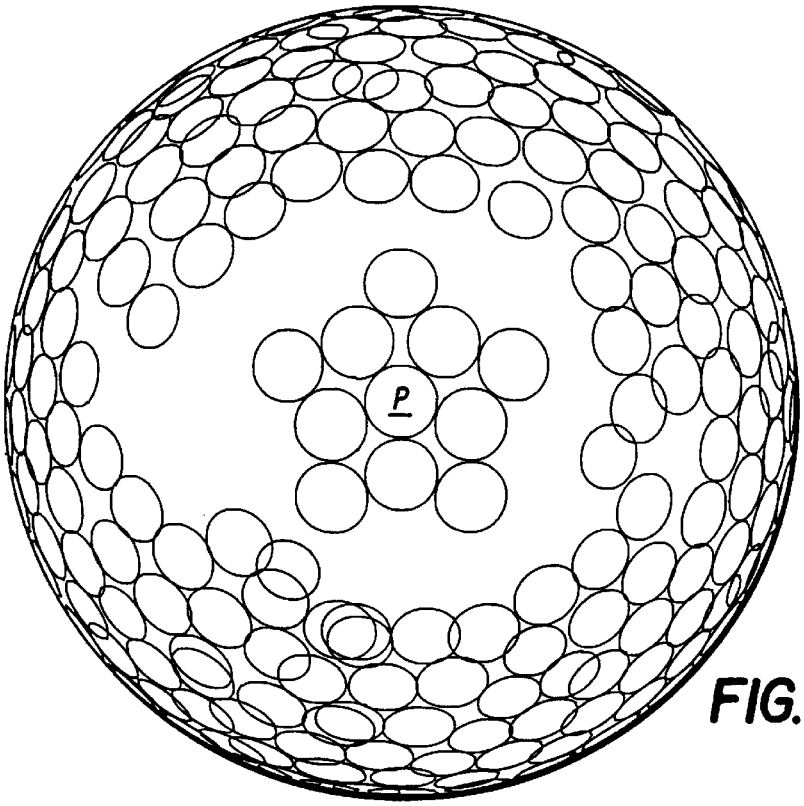
Figure 12:
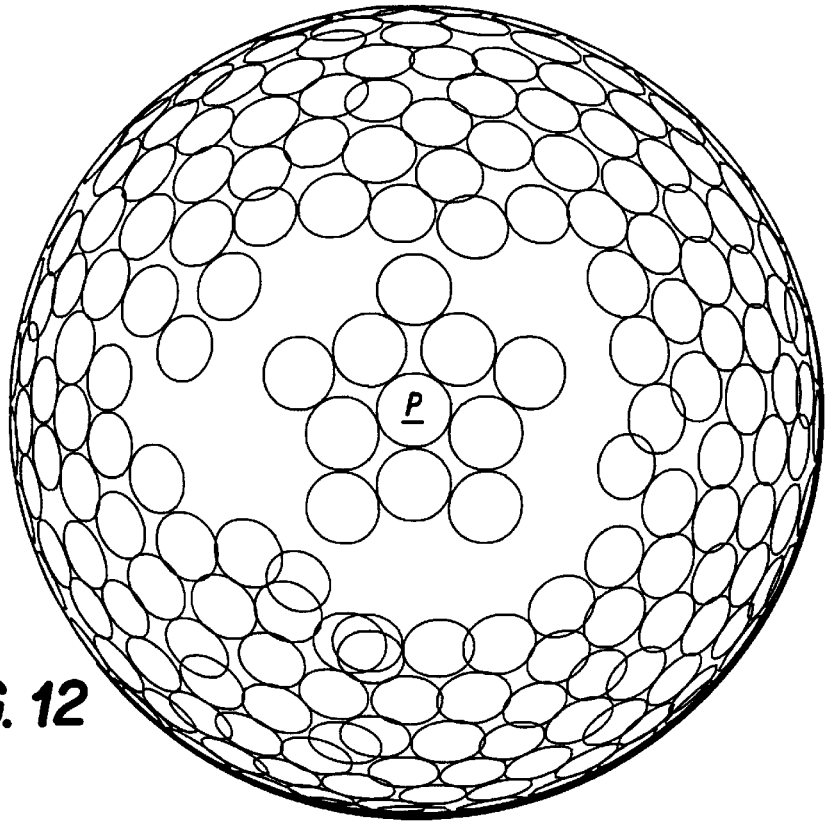

FIGS. 9 and 10 show the initial starting location of the selected dimples. FIG. 11 shows the location of the dimples after 20 iterations. FIG. 12 shows dimple location after 40 iterations. FIG. 13 shows dimple locations after approximately 200 iterations. FIG. 14 shows dimple locations after approximately 10,000 iterations. FIG. 15 shows the final dimple locations after approximately 34,000 iterations.

The ball of FIGS. 9–15 includes polar dimple P and surrounding dimples, all of which are in fixed positions and are not moved during the iterations. The ball also includes equatorial dimples which are in fixed positions. In the example shown in FIGS. 9–15, each hemisphere of the ball includes a total of 202 dimples with each hemisphere including 63 dimples having a diameter of 0.1550 inch, 77 dimples having a diameter of 0.1480 inch, and 62 dimples having a diameter of 0.1400 inch. The resultant dimple coverage is 78.2%.

It is to be understood that the above specific descriptions and mathematics illustrate one means for providing the dimple patterns of the present invention. Other procedures could be devised to accomplish the same results. Accordingly, the scope of the invention is to be limited only by the following claims.

We claim:

1. A golf ball having dimples on the surface thereof comprising a dimple-free equatorial line dividing said golf ball into two hemispheres;

each of said hemispheres having an equal number of dimples;

each hemisphere having a plurality of dimples arranged in a configuration about the surface of said hemisphere so that there are no repeating patterns within the hemisphere.

2. The golf ball of claim 1 wherein said dimples have at least two different diameters.

3. The golf ball of claim 1 wherein none of said dimples overlap.

* * * * *